United States Patent [19]

Hayden

[11] Patent Number: 4,462,791

[45] Date of Patent: Jul. 31, 1984

[54] FIRE LIGHTER

[76] Inventor: Richard Hayden, 1459 James St., SE., Marietta, Ga. 30060

[21] Appl. No.: 412,528

[22] Filed: Aug. 30, 1982

[51] Int. Cl.[3] ..... F23D 13/24

[52] U.S. Cl. ..... 431/345; 431/254; 431/274; 431/277; 126/25 B

[58] Field of Search ..... 431/345, 343, 253, 254, 431/276, 277, 274, 275; 126/401, 25 B

[56] References Cited

U.S. PATENT DOCUMENTS 4,315,731 2/1982 Moore ..... 431/345

FOREIGN PATENT DOCUMENTS 299475 6/1914 Fed. Rep. of Germany ..... 431/274

321763 6/1920 Fed. Rep. of Germany ..... 431/274

*Primary Examiner*—Randall L. Green

*Attorney, Agent, or Firm*—Jones & Askew

[57] ABSTRACT

Firelighting apparatus for lighting fires comprising a holder for use in combination with a lighter of the type having a separate rotatable flint sticker and a movable fuel valve. The holder includes a first elongate member having a mounting adjacent its remote end for removably mounting the lighter thereto. A second elongate member has mounted adjacent its remote end a frictional engaging member. The first and second elongate members are mounted for relative longitudinal movement therebetween such that relative movement in one direction causes the frictional engaging member to consecutively rotate the flint striker and engage the fuel valve to light the lighter and relative movement in the opposite direction to extinguish the lighter.

3 Claims, 4 Drawing Figures

FIRE LIGHTER

TECHNICAL FIELD

The present invention relates to lighters, or ignition devices, and more particularly to an extension for holding a lighter for remote operation.

BACKGROUND OF THE INVENTION

In certain applications, it is desirable to light a fire from a remote location. For example, gas lighters or artificial logs in a fireplace or a gas grill often require one to place a hand in a position which can cause damage or injury to the hand when the gas ignites. Furthermore, it is sometimes inconvenient to reach into a fireplace or the like to a position suitable for igniting the material therein without assuming awkward positions or soiling oneself from ashes or other residue.

Various devices are known for remote ignition, for example U.S. Pat. Nos. 4,253,820; 4,222,734; 4,013,398 and 4,259,059 (all incorporated herein by reference). However, the devices disclosed therein are relatively complicated and/or are not suitable for use with inexpensive commercially-available fire sources such as conventional lighters for lighting cigarettes, cigars and the like.

BRIEF DESCRIPTION OF THE INVENTION

The present invention relates to an apparatus for lighting fires comprising a holder for use in combination with a lighter of the type having a separate rotatable flint striker and a movable fuel valve. The holder includes a first elongate member having a mounting adjacent its remote end for removably mounting the lighter thereto. A second elongate member has mounted adjacent its remote end a frictional engaging member. The first and second elongate members are mounted for relative movement therebetween such that relative movement in one direction causes the frictional engaging member to consecutively rotate the flint striker and engage the fuel valve to light the ligher and relative movement in the opposite direction to extinguish the ligher.

Accordingly, it is an object of the present invention to provide an improved lighter.

Another object of the present invention is to provide a holder for a conventional lighter.

A further object of the present invention is to provide a lighter for remote operation.

Another object of the present invention is to provide a holder for a lighter which is relatively uncomplicated to construct.

Yet another object of the present invention is to provide a lighter which can be operated with one hand.

These and other objects, features and advantages of the present invention will become apparent after a review of the following detailed description of the preferred embodiment and the appended drawing and claims.

DESCRIPTION OF THE PREFERRED EMBODIMENT

Figure 4:
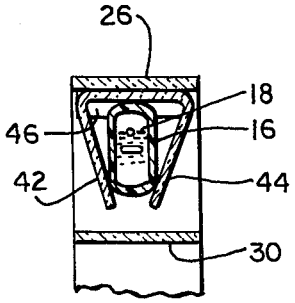
FIG. 4 is a cross-sectional view, taken along the line 4—4, of the lighter shown in FIG. 3.

Referring now to the drawing in which like numbers indicate like elements throughout the several views, it will be seen that there is an ignition device 10 in accordance with the present invention which comprises a holder 12 and a conventional lighter 14 for lighting cigarettes, cigars and the like. Such lighters are well known in the art and include a hollow body portion 16 (FIG. 4) for containing a quantity of liquid butane 18 or other similar flammable material which is either under pressure or has a sufficiently low boiling point. A valve (not shown) is actuated by a lever 20 which opens and closes the valve thereby releasing a quantity of butane gas from a burner nozzle (not shown). Located adjacent the nozzle is a flint (not shown) which contacts a flint wheel 22 rotatably mounted to the lighter 14. Rotation of the wheel 22 produces a spark adjacent the nozzle which can ignite the flammable gas emerging from the nozzle to produce a flame 24 (FIG. 4).

Lighters 14 of this type are generally designed for hand operation. The body 16 is grasped in the fingers and the thumb is placed on the wheel 22. The thumb is used to rotate the wheel 22 which produces a spark. As the thumb slips off the wheel 22, it presses downward on the lever 20 opening the valve to permit the butane gas to escape. To extinguish the flame 24, the thumb is removed from the lever 20 which is biased or spring loaded, thereby closing the valve. Lighters of this type construction are well known in the art and are generally available under trademarks such as "Scripto", "Cricket" and "Bic".

The holder 12 for the lighter 14 comprises a first elongate member 26 having a first leg member 28 forming approximately a right angle therewith and a second elongate member 30 having a second leg member 32 forming approximately a right angle therewith. The first leg member 28 is attached to the second leg member 32 by a member 34. The members 28, 32, 34 provide a handle which can be conveniently gripped in the hand.

The members 26–32 are preferably formed from a single piece of plastic material, such as polyethylene, by bending the plastic at the corners 35, 36, 38, 40. The plastic material should be sufficiently flexible so that it will bend slightly without breaking, for example when the handle is squeezed.

Mounted on the first elongate member 26 adjacent the end remote from the handle is a pair of opposed flanges 42, 44. The flanges 42, 44 are angled inwardly toward each other at their edges opposite the first elongate member 26. The body portion 16 of the lighter 14 is removably held in place between the flanges 42, 44. A stop 46 is attached to the underside of the first elongate member behind the flanges 42, 44 so that the lighter 14 will not slide rearwardly past the stop.

Figure 1:
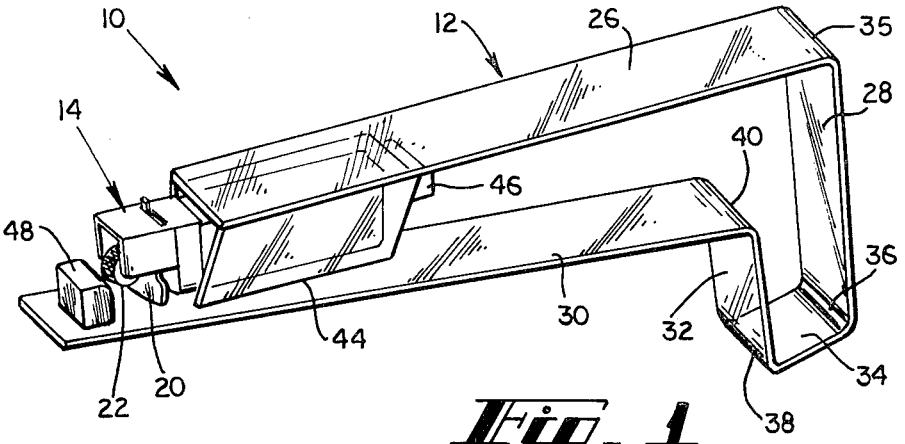
FIG. 1 is a pictorial view of a disclosed embodiment of the lighter of the present invention.
Figure 2:
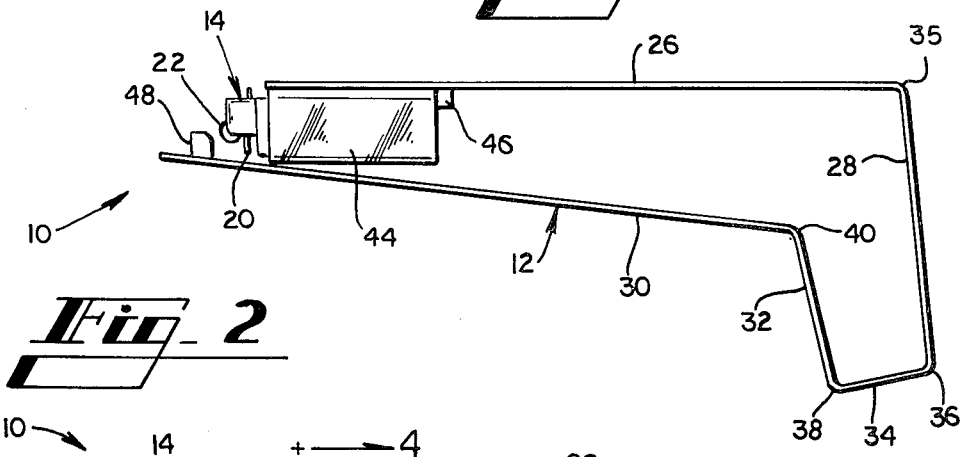
FIG. 2 is a side view of the lighter shown in FIG. 1.
Figure 3:
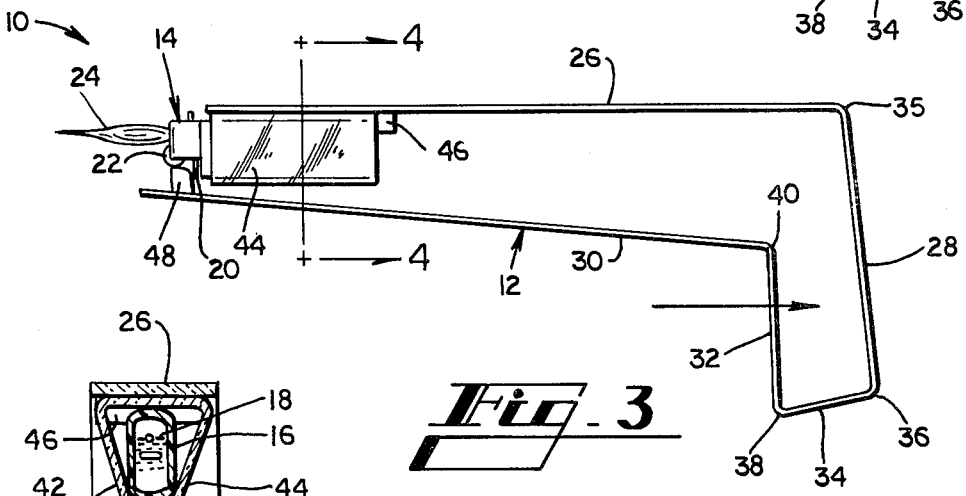
FIG. 3 is a side view of the lighter shown in FIG. 1 with the elongate L-shaped member pulled in the direction shown by the arrow.

Attached to the top surface of the second elongate member 30 is a frictional engaging member 48. The member 48 is arranged on the second elongate member 30 and is sized and shaped so that as the second elongate member is moved in a longitudinal direction with respect to the first elongate member 26 from the position shown in FIG. 2 to the position shown in FIG. 3, the frictional engaging member contacts and rotates the flint wheel 22 to produce a spark and then contacts and depresses the lever 20 to open the valve and release the flammable gas from the nozzle, thereby lighting the lighter 14. The engaging member 48 is preferably made of an elastomeric material having a sufficient coefficient of friction so that it will rotate the flint wheel 22, and having a sufficient hardness so that repeated engagement with the flint wheel will not wear the material too severely and so that the material will not deform significantly when engaging the lever 20.

Use of the present invention will now be considered. The lighter 14 is inserted between the flanges 42, 44 until the body portion 16 contacts the stop 46. The handle portion of the holder 12 is grasped in the hand so that the first leg member 28 rests in the palm of the hand and the fingers wrap around the second leg member 32. The ignition device 10 is therefore in the position shown in FIG. 2.

Suitable combustible materials (not shown) are placed in a fireplace (not shown). The end of the ignition device 10 including the lighter 14 is extended into the fireplace to a point adjacent the combustible materials therein. The fingers of the hand are then squeezed so that the second elongate member 30 and the second leg member 32 are moved toward the first leg member 28 in the directon shown by the arrow in FIG. 3. As the second elongate member 30 moves longitudinally with respect to the first elongate member 26, the frictional engaging member 48 consecutively rotates the flint wheel 22 producing a spark, and depresses the lever 20 releasing the butane gas from the nozzle. The spark ignites the butane gas to produce a flame 24 which can then be used to ignite the combusible material in the fireplace. When the combustible material is satisfactorily ignited by the flame 24 from the lighter 14, the pressure of the fingers of the hand can be released from the second leg member 32, whereupon the second elongate member 30 will move longitudinally in the direction opposite the arrow shown in FIG. 3 and will assume the position shown in FIG. 2 due to the resiliency of the plastic material from which the holder 12 is made. As the second elongate member 30 moves in this opposite direction, the frictional engaging member disengages the lever 20 which under spring tension closes the fuel valve, thereby cutting off the flow of butane gas and extinguishing the flame 24.

When the butane fuel is the lighter 14 is completely consumed, the lighter can be removed from between the flanges 42, 44 by sliding the lighter forwardly and a new lighter substituted in its place.

It should be understood, of course, that the foregoing relates only to a preferred embodiment of the present invention and that numerous modifications or alterations may be made therein without departing from the spirit and scope of the invention as set forth in the appended claims.

I claim:

1. A holder for a lighter of the type having a separate rotatable flint striker and a movable fuel valve, said holder comprising:

a first L-shaped elongate member;

means for removably mounting said lighter adjacent the remote end of said first elongate member;

a second L-shaped elongate member spaced apart from said first elongate member and in proximately parallel relation thereto, with said mounting means facing toward said second elongate member;

a frictional engaging member mounted on said second elongate member adjacent the remote end thereof, facing said mounting means in position to engage the flint striker and fuel valve of a lighter held in said mounting means; and connecting means for movably mounting said second elongate member with respect to said first elongate member such that movement of said second elongate member in one direction relative to a parallel portion of said first elongate member causes said frictional engaging member to move toward said mounting means for said lighter so as to consecutively rotate said flint striker and engage said fuel valve to light said lighter, and such that relative movement in the opposite direction causes said frictional engaging member to move away from said mounting means to disengage said fuel valve;

said first L-shaped elongate member comprising a first longitudinal portion having proximal and remote ends, and has a first leg portion joining said first longitudinal portion at said proximal end and extending at a substantial angle to said first longitudinal portion;

said second L-shaped elongate member comprising a second longitudinal portion having proximal and remote locations, and has a second leg portion joining said second longitudinal portion at said proximal end and extending at a substantial angle to said second longitudinal portion;

said first and second leg portions having outer ends interconnected by said connecting mounting means to dispose said leg portions in mutually spaced apart and proximately parallel confronting relationship, said first and second leg portions providing a manually squeezable hand grip;

said first leg portion being longer than said second leg portion so as to dispose the proximal end of said first elongate member spaced above said proximal location of said second elongate member, so that squeezing and releasing said leg portions causes mutual reciprocal movement of said longitudinal portions;

said frictional engaging member being mounted adjacent said remote end of said second longitudinal portion to confront said remote end of said first longitudinal portion; and said lighter mounting means being mounted adjacent said remote end of said first longitudinal portion so that the lighter is mounted between said mutually spaced apart longitudinal portions in position for said flint striker and fuel valve to consecutively engage said frictional engaging member as said longitudinal portions are relatively moved in said one direction in response to manually squeezing said hand grip.

2. A holder as in claim 1 wherein said holder comprises a unitary piece of rigid, flexible material further comprising said hand grip, and said interconections between the connecting mounting means and the leg portions being bendable to permit said leg portions to move in response to squeezing.

3. The holder as in claim 1, wherein:

said first and second L-shaped elongate members comprise a unitary flat piece of rigid flexible material bent at a pair of corners to form the respective L-shapes, so that each elongate member has a leg portion extending from a respective said corner to define a leg portion having a first end at the corner and having a second end remote from the corner; and said unitary flat piece being bent at least at one other location to form said movably mounting means interconnecitng said second ends of said leg portions, so that said leg portions are mutually spaced apart by said movable mounting means and thereby provide a manually squeezable hand grip which causes said relative movement of the elongate members to actuate a lighter in said mounting means.

* * * * *